US008291661B2

(12) United States Patent
Bengry et al.

(10) Patent No.: US 8,291,661 B2
(45) Date of Patent: Oct. 23, 2012

(54) INTERLOCKING FLOOR

(75) Inventors: Jay Frederick Bengry, Negaunee, MI (US); Michael W Niese, Cincinnati, OH (US)

(73) Assignee: Robbins, Inc., Cincinnati, OH (US)

( * ) Notice: Subject to any disclaimer, the term of this patent is extended or adjusted under 35 U.S.C. 154(b) by 320 days.

(21) Appl. No.: 11/937,238

(22) Filed: Nov. 8, 2007

(65) Prior Publication Data

US 2008/0060305 A1 Mar. 13, 2008

Related U.S. Application Data

(63) Continuation of application No. 10/994,576, filed on Nov. 22, 2004, now abandoned.

(60) Provisional application No. 60/523,598, filed on Nov. 20, 2003.

(51) Int. Cl.
*E04F 15/00* (2006.01)

(52) U.S. Cl. ..... 52/392; 52/390; 52/480; 52/578; 52/592.1; 52/403.1; 52/747.1

(58) Field of Classification Search ..... 52/480, 52/484.1, 582.1, 578, 390, 584.1, 592.1, 52/589.1, 747.1, 506.05, 410, 391, 403.1, 52/392, 793.1; 472/92; 428/50
See application file for complete search history.

(56) References Cited

U.S. PATENT DOCUMENTS

| | | | | | |
|---|---|---|---|---|---|
| 1,045,219 | A | | 11/1912 | Tramill | |
| 1,407,679 | A | | 2/1922 | Ruthrauff | |
| 1,546,130 | A | | 7/1925 | Henry | |
| 1,649,842 | A | | 11/1927 | McBride | |
| 2,862,255 | A | * | 12/1958 | Nelson | 52/403.1 |
| 3,511,001 | A | | 5/1970 | Morgan, Jr. | |
| 3,967,428 | A | | 7/1976 | Pierce et al. | |
| 4,443,989 | A | * | 4/1984 | Silvey et al. | 52/402 |
| 4,538,392 | A | | 9/1985 | Hamar et al. | |
| 4,600,336 | A | * | 7/1986 | Waller, Jr. | 404/35 |
| 4,890,434 | A | | 1/1990 | Niese | |
| 4,995,210 | A | | 2/1991 | Niese et al. | |
| 5,016,413 | A | | 5/1991 | Counihan | |
| 5,299,401 | A | * | 4/1994 | Shelton | 52/393 |
| 5,303,526 | A | * | 4/1994 | Niese | 52/393 |
| 5,365,710 | A | | 11/1994 | Randjelovic | |
| 5,369,927 | A | | 12/1994 | Counihan | |
| 5,412,917 | A | | 5/1995 | Shelton | |
| 5,490,361 | A | | 2/1996 | Gingras | |
| 5,511,353 | A | | 4/1996 | Jones | |

(Continued)

*Primary Examiner* — Robert J Canfield
*Assistant Examiner* — Jessie Fonseca
(74) *Attorney, Agent, or Firm* — Wood, Herron & Evans, L.L.P.

(57) ABSTRACT

A modular floor includes a plurality of interconnected, uniform and elongated floor sections. Each floor section includes a wear layer, an upper subfloor panel, a lower subfloor panel and a plurality of parallel spacers sandwiched between the upper and lower subfloor panels. The spacers extend horizontally outwardly from three sides of the sections, including both longitudinal sides and one transverse side, but are recessed on the remaining transverse side. The parallel spacers extend into the recesses of adjacently located floor sections, alongside the corresponding spacers of those floor sections, along the longitudinal sides. At the transverse sides, each section has a spacer that extends into an adjacently located section in the same row and also receives a spacer from an adjacently located section in the same row. The sections have hardware connections that are concealed from view, and connecting each subsequent section requires two fasteners. The modular floor system of the invention is structurally rigid and uniform in appearance, but has lower installation, handling and manufacturing costs. Also, the uniform floor sections may be installed from the center of the floor.

11 Claims, 4 Drawing Sheets

U.S. PATENT DOCUMENTS 5,603,134 A 2/1997 Whipkey et al.
5,609,000 A 3/1997 Niese
5,647,183 A 7/1997 Counihan
5,682,724 A 11/1997 Randjelovic
5,778,621 A 7/1998 Randjelovic
5,822,944 A * 10/1998 Penland, Sr. ..... 52/591.1
5,987,839 A 11/1999 Hamar et al.
6,032,427 A 3/2000 Randjelovic
6,055,785 A 5/2000 Counihan
6,073,409 A 6/2000 Chambers
6,115,981 A 9/2000 Counihan
6,122,873 A 9/2000 Randjelovic
6,158,185 A 12/2000 Counihan
6,173,548 B1 1/2001 Hamar et al.
6,367,217 B1 4/2002 Niese et al.
6,550,206 B2 * 4/2003 Lee ..... 52/480
6,557,314 B2 5/2003 Shelton
6,637,169 B2 * 10/2003 Niese et al. ..... 52/480
6,688,065 B2 2/2004 Chambers
6,880,305 B2 * 4/2005 Pervan et al. ..... 52/480
2004/0040242 A1 3/2004 Randjelovic
2004/0103602 A1 * 6/2004 Geraud ..... 52/403.1
2004/0237452 A1 12/2004 Niese et al.

* cited by examiner

INTERLOCKING FLOOR

CROSS-REFERENCE TO RELATED APPLICATION

The present application is a continuation of U.S. patent application Ser. No. 10/994,576, filed Nov. 22, 2004, now abandoned, which claimed benefit of U.S. Provisional Application Ser. No. 60/523,598, filed on Nov. 20, 2003, both of which applications are incorporated by reference herein in their entirety.

FIELD OF THE INVENTION

The present invention relates to floors, and more particularly, to a hardwood floor constructed from a plurality of connectable floor sections.

BACKGROUND OF THE INVENTION

Wood floors remain popular for athletic facilities, particularly for basketball floors. In a typical hardwood floor, a wear layer of floorboards resides over a base, with a subfloor residing below the wear layer and above the base. If the floor is resilient, a layer of pads resides between the subfloor and the base. Among such floors, modular assemblies provide particular advantages for many venues. A modular floor is a floor constructed from a plurality of sections. Modular floors, which include portable floors, may be disassembled and reassembled to allow a particular facility to optimize the usage of a given floor space. Namely, the selective removal of a modular floor allows a facility to accommodate activities that do not call for hardwood flooring.

Modular floors include a plurality of individual sections that connect to adjacently located sections to form a playing surface, for activities such as basketball, volleyball, aerobics and dance. Prior to installation, the sections must be sorted and arranged according to their respective positions within the overall sports surface. A typical modular floor may include up to a dozen different types or shapes of sections. For instance, the floor may include corner, end and connecting sections that have different dimensions and require particular orientations. An installation crew typically begins to position, orient and attach the sections by working from one corner of the room to an opposite corner. This assembly sequence necessarily limits the speed with which the floor can be installed.

One common mechanism for attaching floor sections involves the use of machine screws that are countersunk into the surfaces of the sections, subfloor locking pins and latches that connect at each corner, as well as machine screws placed in strategically positioned subfloor brackets. Even with a skilled installation crew, the time consuming processes of sorting, placing and attaching the sections accounts for a significant portion of floor's cost.

In part because of these labor requirements, there remains a high customer demand for improved floor performance and lower costs. These demands translate to an objective of supplying a floor of high structural integrity, but which requires a shorter installation time. Other goals include easier handling and manufacture of the floor components, as well as fewer floor components. Still, achieving these objectives must not compromise other attributes of the floor, such as the ruggedness and the aesthetic appearance.

It is therefore an object of the present invention to simplify and reduce the time and cost of installing a modular floor made of interconnected floor sections.

It is also an object of the present invention to eliminate the speed limitations associated with installing a modular floor from one corner of a room to the opposite corner.

It is another object of the inventor to reduce the manufacturing costs of a wooden floor.

SUMMARY OF THE INVENTION

The present invention achieves the above-stated objects via a modular floor made of uniformly sized and shaped interconnectable, elongated rectangular sections. The sections have staggered subfloor spacers that extend horizontally outwardly on three sides thereof to cooperatively interlock with spacers of adjacently located sections. This construction locks the floor sections in a rigid floor assembly. The uniformly sized and shaped sections include connecting pins at two of the four corners.

Thus, each of the floor sections can be moved into position and physically connected to already-secured sections via attachment at only two corners. This structure simplifies assembly, reduces assembly time and lowers the overall cost to the customer.

Also, the uniformity of the floor sections eliminates the onsite guesswork of deciding which shaped section goes where. All of the uniformly shaped sections can be easily connected to any adjacently located, already installed floor sections. The modular floor of the invention has rugged and uniformly connectable sections that may be attached with minimal planning, and that also may be installed simultaneously in different directions, thereby reducing installation time. With a first section placed in the middle of the floor, the installation crew can attach floor sections in all directions.

This uniformity in size and shape of the sections leads to other advantages, such as simplified and lowered manufacturing costs. This simplification and reduction in manufacturing costs results from the elimination of multiple sizes and shapes for the floor sections. The sections are all the same, and are therefore more easily manufactured in a more cost-effective manner.

Accordingly to a first preferred embodiment of the invention, a modular floor can comprise a plurality of interconnected, elongated floor sections. Each of the floor sections includes an upper wear layer, an upper layer below the upper wear layer, and a lower layer below the upper layer. A plurality of parallel spacers are sandwiched between the upper and lower layers. The spacers extend horizontally beyond three sides of the section, including both longitudinal edges, and are recessed on one traverse side.

If the sections are 2'×8' in dimension, for each section the upper wear layer may comprise a plurality of parallel floorboards. These floorboards may be tongue and groove, if desired, but do not have to be. Also, the floorboards may advantageously utilize the benefits of assignee's U.S. Pat. No. 5,930,967, which is expressly incorporated by reference herein in its entirety. In other words, the floorboards may comprise end-to-end pieces connected by finger joints, with each piece having a top floor component of one material, such as maple, and a lower component of a second material. From the top of the floor surface, this gives the appearance of a random length maple floor.

For each section, the upper and lower layers may be panels of plywood. The wear layer is secured to the upper layer by fasteners and/or adhesive. The sandwiched spacers may be of any sufficiently rigid material.

The invention contemplates some degree of resiliency for the floor, if desired by the customer. This can be done by attaching a plurality of pads to the bottoms of the sections.

The pads could be encased within structures found in assignee's U.S. Pat. No. 5,303,526. Alternatively, a foam pad could be rolled out over the base of the floor, prior to interconnection of the sections.

The invention contemplates floor sections with spacers, but not necessarily spacers that traverse the widths of the sections. For instance, the spacers could be located at the sides only. Also, in some environments it may be desirable to eliminate the lower layer altogether, so that the spacers provide the support, with or without some lower resilient material, such as pads or a foam layer.

This modular floor can be installed in multiple directions once a floor section is situated in the middle of the floor. The sections are identical, so installation can occur simultaneously in all directions. Thereafter, the installed floor section can be sanded, and then painted or coated with a protective coating, such as polyurethane.

These floor sections are removably connected, but are not necessarily meant to be repeatedly disassembled, removed and then reassembled as in a facility that accommodates both basketball and hockey by using a portable floor. It is contemplated that the floor can be removed, if needed, but probably not too frequently. But this capability makes this floor a good candidate for leasing options, or other payment schemes that may better accommodate budget concerns, as opposed to a one-time capital outlay for a permanent floor, or even a portable floor, that is purchased and reused. If the floor is removed and reinstalled, the sections can be arranged in the same pre-configured pattern, if desired Alternatively, they could be installed randomly, again in all directions, and then re-sanded, repainted and refinished.

These and other features of the invention will be more readily understood in view of the following detailed description and the drawings.

DETAILED DESCRIPTION OF THE PREFERRED EMBODIMENTS

Figure 1:
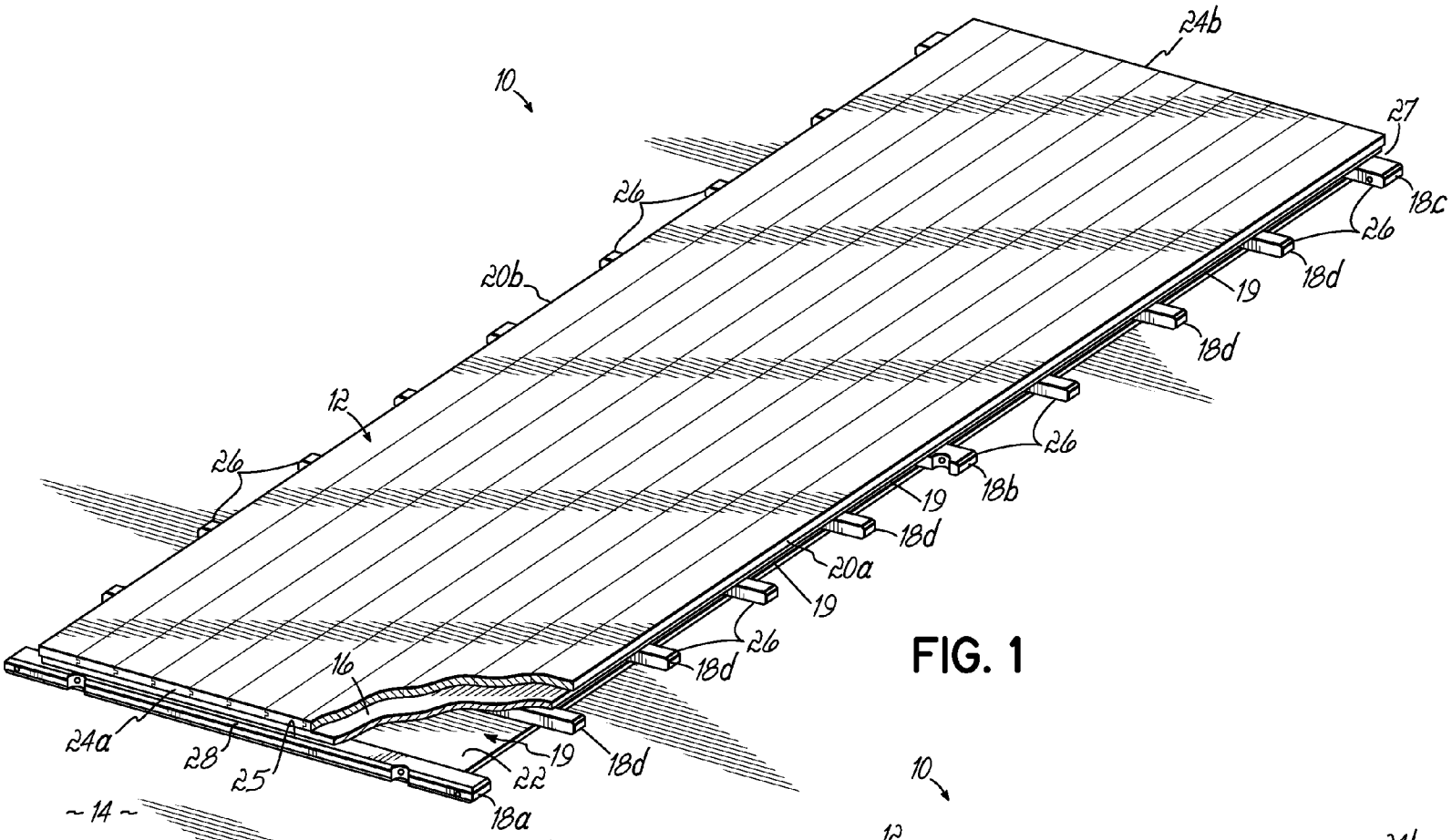
FIG. 1 is a perspective view, partially broken away, that shows a modular floor section according to a first preferred embodiment of the invention.

FIG. 1 shows, in perspective view with a partially broken away portion, a floor section 10 constructed in accordance with a first preferred embodiment of the invention supported on a flat, substantially horizontal base 14. Each floor section 10 includes a plurality of parallel rows of floorboards laid end-to-end, thereby to form a wear layer 12 for the floor section 10. An upper subfloor layer 16 supports the floorboards of the wear layer 12 above a plurality of spaced spacers 18*a*, 18*b*, 18*c*, 18*d*. Reference numeral 18*a* refers to the spacer oriented along one transverse side, reference numeral 18*b* refers to a spacer that is near the center, at a particular distance relative to spacer 18*a*, as will be described later, while reference numeral 18*c* refers to the spacer oriented along the other traverse side, and reference numeral 18*d*, is used for each of the plurality of intermediately located spacers. The spacers 18*a*, 18*c*, 18*d* extend outwardly from under the longitudinal edges 20*a* and 20*b* of the wear layer 12. Spacer 18*a* additionally extends outwardly from under transverse edge 24*a*, while spacer 18*c* is recessed with respect to transverse edge 24*b*. When assembled within a floor system, the parallel spacers 18*a*, 18*c*, 18*d* of the section 10 extend into recesses of adjacently located floor sections. The spacer 18*a* along transverse edge 24*a* additionally extends into an open space formed by a corresponding recessed spacer 18*c* and an upper layer of an adjacent section in the same row. Cooperation between the recessed spacers 18*a*, 18*b*, 18*c*, 18*d* and the adjacent floor sections secures them together. As shown in the first preferred embodiment of FIG. 1, a lower subfloor layer 22 of the floor section 10 effectively sandwiches the spacers 18*a*, 18*b*, 18*c*, 18*d* in combination with the upper layer 16.

Turning more particularly to the different components comprising the exemplary floor section 10 of FIG. 1, the floorboards of the wear layer 12 are tongue and groove, as is well known in the hardwood floor industry. The floorboards shown in FIG. 1 are preferably pre-finished. That is, the floorboards of the section 10 are sanded and sealed at the factory prior to arrival at the installation site. This feature reduces installation time otherwise required for finishing modular floorboards. Once the section 10 is initially installed, for instance, an installer may only need to paint on lines. If desired, the wear layer 12 could comprise something other than parallel rows of elongated floor boards laid end to end, such as parquet sections, laminate or some other nonstructural wear layer. Nevertheless, the present invention is particularly suited for a wear layer 12 of parallel rows of floorboards.

Additionally, the advantageous structural support provided by the upper layer 16 in combination with the plurality of spacers 18*a*, 18*b*, 18*c*, 18*d* allows the floorboards of the wear layer 12 to be of thinner thickness than comparable floorboards of conventional floors. For example, conventional floorboards are at least three quarters of an inch thick. However, the floorboards of the wear layer 12 shown in the embodiment of FIG. 1 may be less than about one half inch, while still maintaining the structural integrity needed to satisfy customer requirements. Benefits associated with using less of the relatively expensive hardwood material of the wear layer translates into significant manufacturing savings.

The upper layer 16 is preferably a panel formed from plywood or any other suitably strong, flexible material that can be readily cut to the desired dimensions. In practice, applicant has used plywood having lateral dimensions commensurate with the wear layer 12 and having a thickness of about three-eighths of an inch. As shown in FIG. 1, the upper layer 16 attaches directly to the spacers 18*a*, 18*b*, 18*c*, 18*d*, as by staples or adhesive. As such, the upper layer 16 supports the floorboards 12.

The plurality of spacers 18*a*, 18*b*, 18*c*, 18*d* that reside below the upper layer 16 are generally parallel and planar. The spacers 18*a*, 18*b*, 18*c*, 18*d* are typically spaced uniformly such that they form recesses 19 of approximately ten inches between them along each longitudinal edge 20*a* and 20*b* of the wear layer 12. That is, the upper and lower layers 16 and 22, respectively, define the vertical dimensions of the recesses 19, while neighboring spacers 18*a*, 18*b*, 18*c*, 18*d* define the horizontal dimensions of each recess 19.

The spacers 18*a*, 18*b*, 18*c*, 18*d* shown in FIG. 1 are positioned transverse to the longitudinal length of the wear layer 12 (and floorboards) such that they extend outwardly and symmetrically from each longitudinal edge 20*a* and 20*b* a distance of about a one and five-eighths inches. As will be clear after a full reading of this specification, the spacers 18*a*, 18*b*, 18*c*, 18*d* extend outwardly into complementary recesses of adjacent floor sections to secure the sections together.

As such, the spacers 18*a*, 18*b*, 18*c*, 18*d* are preferably about twenty-eight inches in length and are centered relative to a width, or transverse end 24*a* of the wear layer 12. While the height of each spacer 18*a*, 18*b*, 18*c*, 18*d* is generally a uniform three-quarters of an inch, the width of the different spacers 18*a*, 18*b*, 18*c*, 18*d* may vary according to their respective position and/or function. Namely, spacers 18*a*, 18*c* may have larger widths than other spacers 18*d* of the plurality. The spacers 18*a*, 18*c* are wider, in part, to accommodate hardware used to secure adjacent floor sections. For instance, spacers 18*a*, 18*c* are generally about one and thirteen-sixteenths of an inch thick. Spacers 18*d* are typically of thinner construction, or about one and three-sixteenths inches in thickness. Typically, each spacer 18*a*, 18*b*, 18*c*, 18*d* comprises maple or pine. The strength of the wooden spacers 18*a*, 18*b*, 18*c*, 18*d* provides support up to the wear layer 12, allowing for thinner, less expensive floorboards.

Figure 1A:
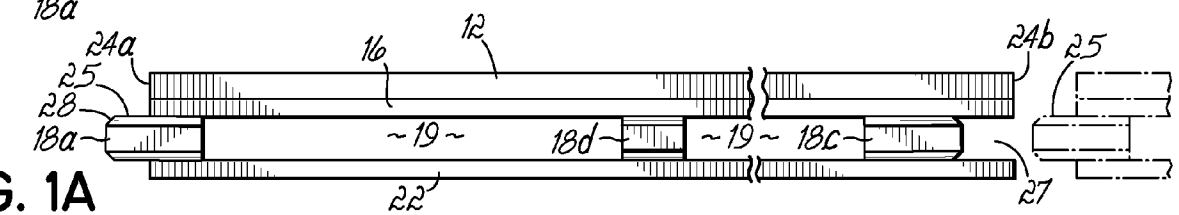
FIG. 1A is an end view of the modular floor section of FIG. 1.

While the spacing between the spacers 18*a*, 18*b*, 18*c*, 18*d* is generally uniform, a spacer 18*a* positioned along a first transverse end 24*a* of the wear layer 12 may be slightly offset. For instance, the spacer 18*a* may extend outwardly along its length from the transverse end 24*a* of the wear layer 12 a distance of about seven-eighths of an inch. As best shown in FIG. 1A, the offset of the end spacer 18*a* functions as an extension 25 that recesses into an offset 27 formed by an upper layer 16 and a recessed spacer 18*c* of an abutting floor section of a common row. The recessed spacer 18*c* of the adjacent floor section of the row may be offset by a distance sufficient to accommodate the seven-eighths of an inch extension of spacer 18*a*. For instance, a preferred embodiment of the present invention recesses spacer 18*c* a full inch from the wear layer.

This extra eighth of an inch tolerance between the offsets 25 and 27, respectively, ensures a snug fit between adjacent floor sections by preventing the spacers 18*a* and 18*c* from contacting. That is, the eighth of an inch difference provides extra insurance that adjacent spacers will not contact and prevent the respective wear layers of sections from abutting. Spacer 18*c* is shown in FIG. 1 having such an offset, or recess, along the opposite transverse edge 24*b* of the floor section 10.

As will become clear after a full reading of this specification, the offset of spacer 18*a* also accommodates placement of a center spacer of an adjacent floor section that is adjacent along longitudinal edge 20*a* or 20*b*. The floor section 10 of FIG. 1 includes a like center spacer 18*b*, which is approximately fifty inches from spacer 18*a*. In any case, an installer uses the offsets 25 and 27 as a guide to readily install a row of floor sections by sliding together the complementary, respective transverse ends of abutting sections. Since all of the sections are alike, and because all of the spacer spacing is optimally machined for interlocking, the installer only needs to align sections in the same direction when sliding them together.

To this end, the ends 26 of the spacers 18*a*, 18*b*, 18*c*, 18*d* are typically beveled. This beveling facilitates insertion into corresponding recesses of an adjacent panel during installation. Similarly, a lead side 28 of spacer 18*a* located along the transverse edge 24*a* is beveled to facilitate installation along a common row.

The lower layer 22 is preferably formed from plywood, or any other suitably strong, flexible material that can be readily cut to the desired dimensions. In practice, applicant has used plywood having lateral dimensions slightly smaller than the wear layer 12 to avoid interference with a lower layer of an adjacent section during installation. As shown in FIG. 1, the lower layer 22 attaches directly to the spacers 18*a*, 18*b*, 18*c*, 18*d*, as by staples or adhesive. In this manner, the lower layer 22 provides structural support to the spacers 18*a*, 18*b*, 18*c*, 18*d*.

The panel 22 is preferably about three-eighths of an inch in thickness, giving the floor section 10 a low profile total height off of the base 14 of about two inches. This low profile provides desirable stability. As shown in FIG. 1, the lower layer 22 directly contacts the base 14. The base 14 is typically concrete, but may be any other sufficiently solid material for rigidly supporting the floor section 10 thereabove.

In another preferred embodiment, the lower layer 22 provides an opportune surface to attach a spacer layer. Where desired, a suitable spacer layer positioned between the base 14 and the lower layer 22 may include carpet, foam, laminate, polymer, encapsulated and other pads, cloth, rubber or any other material having a resilient or other quality that permits a desired degree of downward deflection of the wear layer 12 upon impact. Pads that are particularly suitable for use in this invention are constructed of EPDM rubber and are shown in Applicant's issued U.S. Pat. No. 5,377,471, entitled "Prefabricated Sleeper for Anchored and Resilient Hardwood Floor System."

Figure 2:
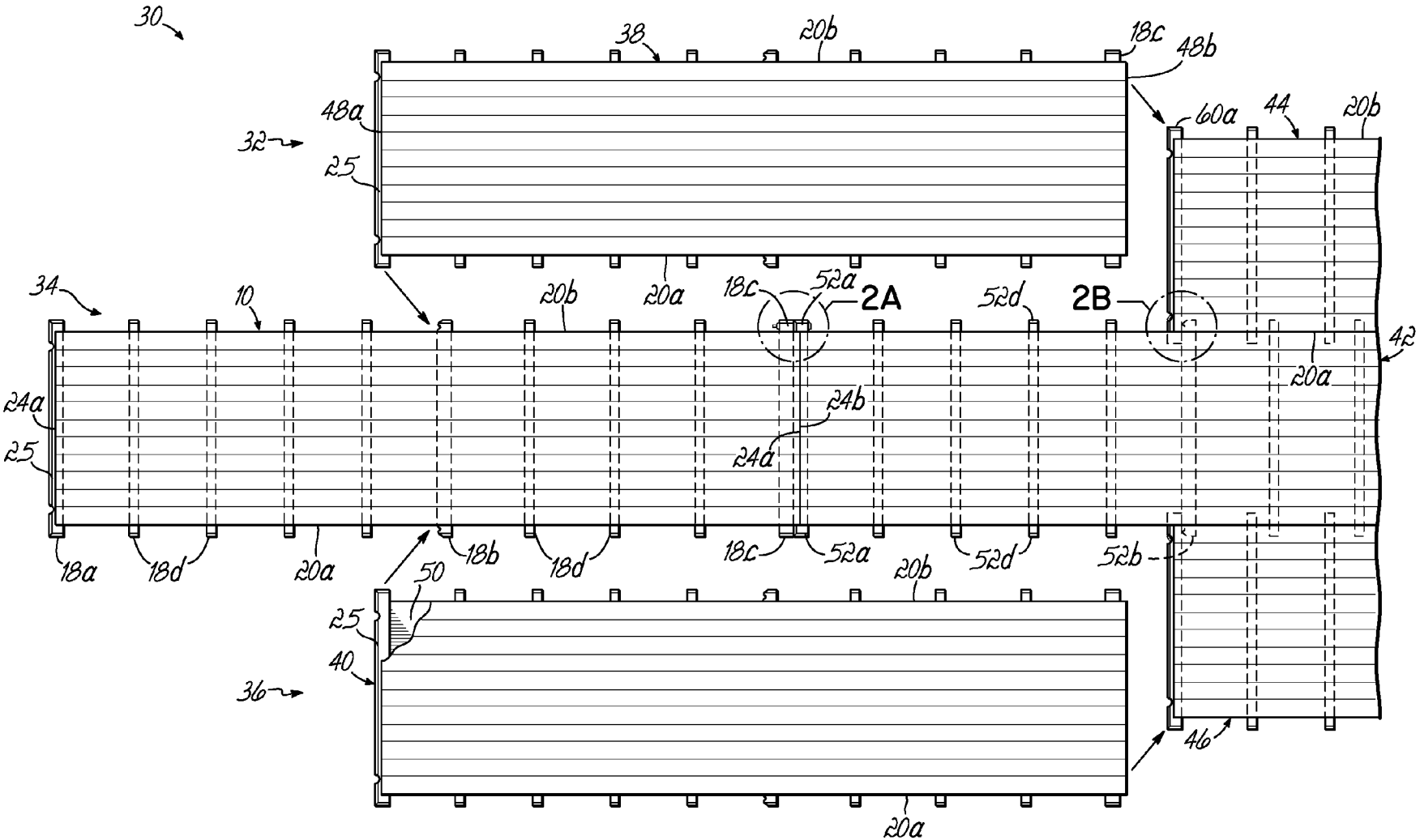
FIG. 2 is a plan view that shows the floor section of FIG. 1 positioned within a partially constructed floor according to the first preferred embodiment of the invention.

FIG. 2 is a plan view that shows the floor section 10 of FIG. 1 positioned within a partially constructed floor system according to the first preferred embodiment of the invention. As shown in FIG. 2, the rows 32, 34, 36 of floor sections 10 and 38, 40, 42, 44, 46 are staggered in an Ashlar pattern. More particularly, the rows 32, 34, 36 are preferably laid out so that the transverse edges 24*a* and 24*b* of a floor section 10 in a first row 34 are staggered with respect to corresponding edges 48*a* and 48*b* of a floor section 38 of an adjacent row 32. The embodiment of FIG. 2 is staggered in four feet intervals. That is, the latitudinal edge 48*a* of one eight foot floor section 38 aligns approximately with the middle of an adjacent eight foot floor section 10, at spacer 18*b*.

Of note, the spacing of the offset connections facilitates the proper alignment of staggered floor sections 10 and 38, 40, 42, 44, 46 by, in part, providing a guide for the installer to ensure that each section is properly and uniformly oriented with respect to one another. The installer only needs to orient spacer 24*a* of a floor section 10 in the same relative direction as spacer 52*a* of an adjacent floor section 42 of a row to achieve the desired staggering. Moreover, the uniform spacing of a center spacer 52*b* relative to spacer 52*a* of each section combination ensures that spacer 60*a* of an adjacent section 44 will nicely fit into a recess defined laterally by spacer 52*a* and 52*b* when installed. As described previously, intermediate spacers 52*d* extend outwardly from the longitudinal edges and into open spaces formed within the adjacently located floor sections 32 and 36 of the adjacent rows. In this manner, delays associated with planning and organizing an installation job are greatly reduced.

Figure 2B:
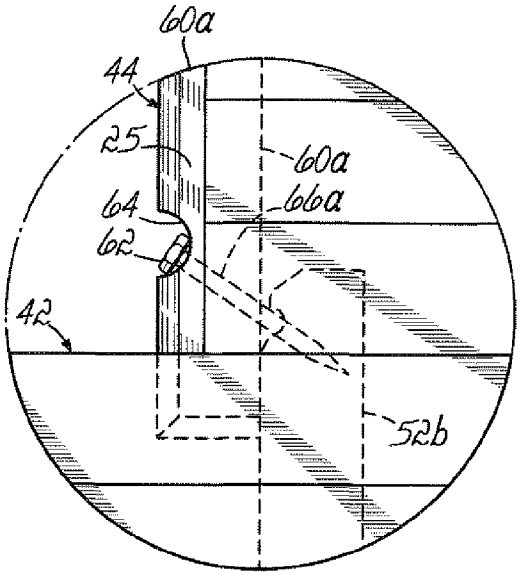
FIG. 2B is an enlarged view taken on encircled area 2B of FIG. 2.
Figure 2A:
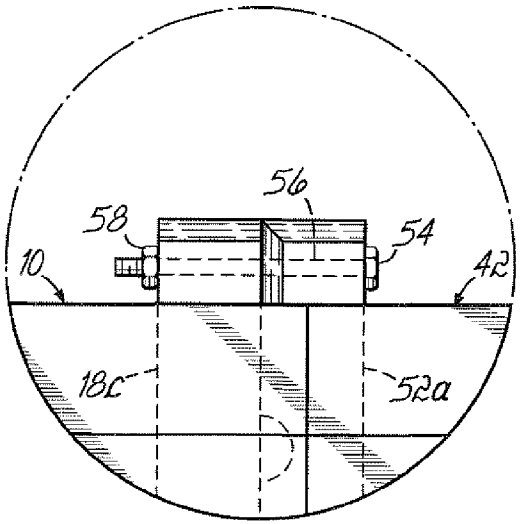
FIG. 2A is an enlarged view taken on encircled area 2A of FIG. 2.

Similarly, the spacing ensures that all other spacers 18*a*, 18*c* extending outwardly from a longitudinal edge 20*a* of a floor section 10 are received within respective recesses 50 of an adjacent floor section 40. Accordingly, a recessed spacer 18*c* forms part of an offset connection for a projecting end spacer 52*a* of longitudinally adjacent section 42. Both end spacers are predrilled at encircled area 2A to accommodate a bolt. As shown in FIG. 2A, the exemplary bolt 54 is inserted into the predrilled hole 56 and secured with a lock nut 58.

Prior to the placement of floor section 38 of FIG. 2 (next to sections 10, 42 and 44 as indicated by the arrows), a screw 62 secures a spacer 60*a* of section 44 to a center spacer 52*b* of an adjacent section 42. This connection is best shown in FIG. 2B. The screw 62 is positioned inside a precut notch 64. The notch 64 presents the installer with an easy reference and serves to recess the head of the screw away from other spacers. Where desired, a guide hole 66*a* may additionally be predrilled into the edge spacer 60*a*.

As such, when each section 10 and 38-46 of the floor system 30 shown in FIG. 2 is installed, each section is bolted with a bolt 54 and a nut 58 on one corner and secured by a screw 62 at the opposite corner. Furthermore, the bolt and screw secure the section 42 to different floor sections 10 and 44, respectively. Section 10 is in an adjacent row, and section 44 is in the same row as section 42. As the installation continues, the result will be that each section 10 and 38-46 will be fastened by a total of two bolts 54 and locknuts 58, and one screw 62. Each section 10 and 38-46 will be connected by fasteners at a total of three of its corners, and two of its longitudinal sides, resulting in rows that are held strongly to their adjacent rows, without any fasteners visible on the floor 30. Optionally, the first starter row, 34, can also be fastened at the fourth corner, since there is no adjacent panel yet blocking access to the fourth corner.

Figure 3:
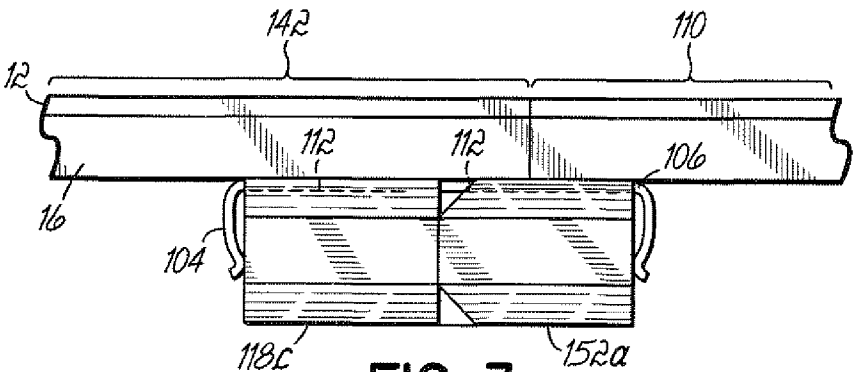
FIG. 3 is an end view showing a variation of the present invention with a clamp fastener connecting respective edge spacers of adjacent panels of a floor according to another preferred embodiment of the present invention.

One skilled in the art will appreciate that a number of alternative and/or additional fasteners may be used in accordance with the principles of the present invention. For instance, the fastener scenario shown in FIG. 3 includes a metal clip 104 that fastens around spacers 118*c* and 152*a* of adjacent floor sections 110 and 142, respectively. Such a clip 104 may be initially glued, screwed or otherwise attached to one of the spacers 152*a*. When the sections 110 and 142 abut during installation, an installer may snap or otherwise attach the clip 104 around the other spacer 118*c* by stepping on a top surface 106 of the clip 104. Clip 104 is held in place by an upper layer of adjacent section when installed. As shown in FIG. 3, the top surface 106 of the clip 104 is recessed within grooves 112 of the spacers 118*c* and 152*a*. The upper layer 16 of another embodiment may alternatively be altered to accommodate the thickness of the top surface 106.

The sections 10 and 38-46 of FIG. 2 are like constructed such that a team of installers can work simultaneously from either side of an installed row 34. This feature further reduces the amount of time needed to install a floor 30 as compared to conventional floors, panels of which are lain in one direction from a single corner.

While each floor section 10, 38-46 is typically 8 feet, or even longer, the staggering of the joints may require that at least some sections be of reduced length to accommodate staggering of adjacent rows at the wall. Due to the uniform and otherwise advantageous spacing of the spacers of each section, however, an installer may halve or otherwise reduce the length by merely cutting an existing, standard floor section 10 to length. That is, the cut for the reduction may be accomplished with little regard to where along the floor section 10 the cut is made, and the remaining portion of the section may additionally be used at another position. This feature thus reduces installation time and material wastage.

Figure 4:
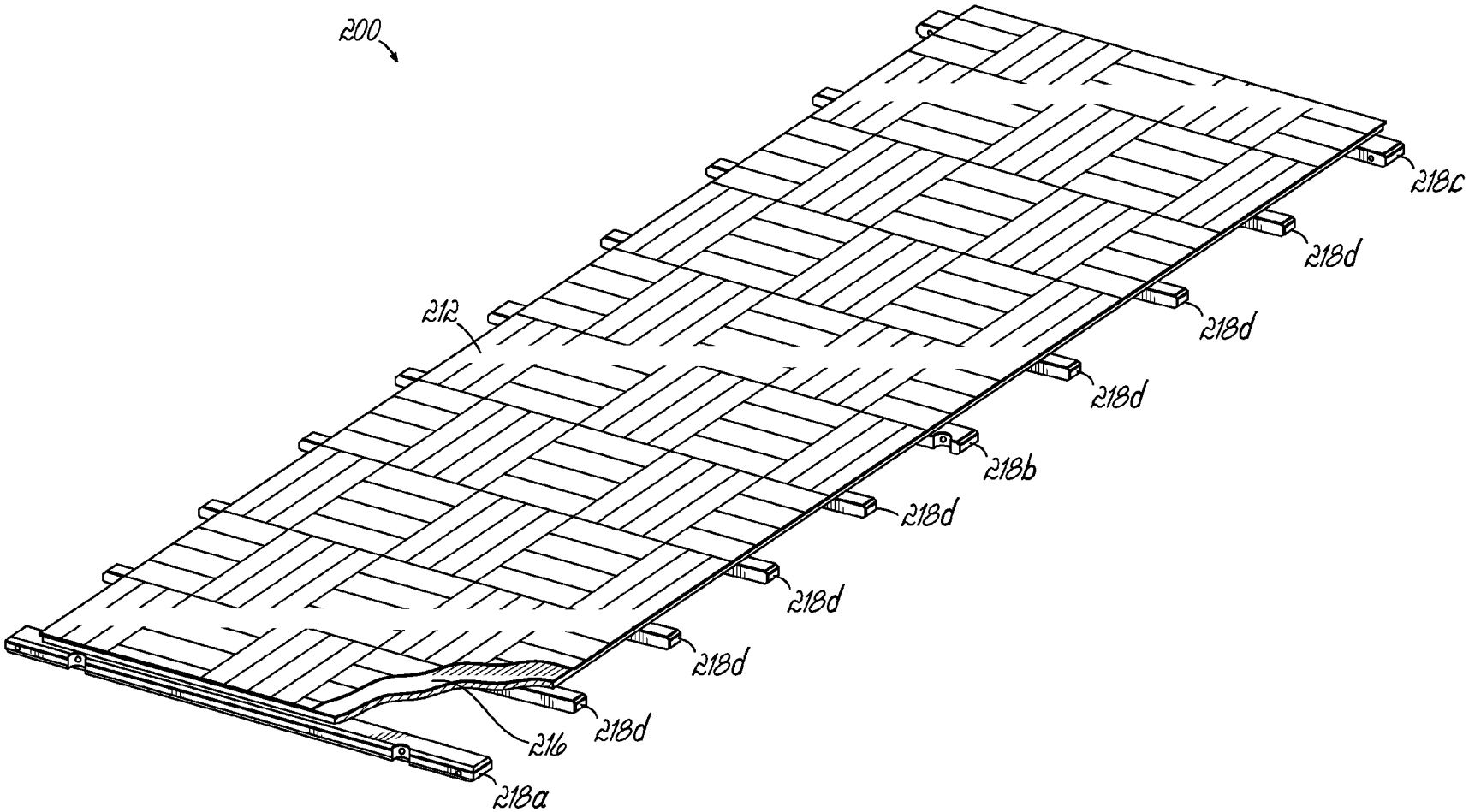
FIG. 4 is a perspective view showing a modular floor section according to another preferred embodiment of the invention that is similar to the first preferred embodiment, but depicting a nonstructural wear layer and no lower layer.

FIG. 4 shows a plan view of a floor section 200 constructed in accordance with another preferred embodiment of the invention. More particularly, the modular floor section 200 of FIG. 4 is similar to the first preferred embodiment of FIG. 1, but with a nonstructural wear layer and no lower layer. As shown in FIG. 4, the floor section 200 includes a non-structural wear layer comprising parquet flooring 212 secured to a support layer 216. As such, embodiments that are consistent with the principles of the present invention may include such nonstructural material, to include rubber or plastic, as well as other types of sportwood. Thus, embodiments that are consistent with the principles of the present invention can flexibly accommodate different wear surfaces per customer needs while still enjoying the herein discussed benefits of the present invention.

Though not shown, one skilled in the art will appreciate that such a nonstructural wear layer may include a continuous plywood sublayer for support considerations. The floor section 200 of FIG. 4 additionally includes no lower layer below the spacers 218*a*, 218*b*, 218*c*, 218*d*. The rest of the floor section is generally the same as described above with respect to FIG. 1.

To install the floor 30 of this invention, a suitable number of floor sections are shipped to the site of installation. The uniform, low profile dimensions of the sections allow a large number of sections to be shipped in a cost effective manner. Furthermore, the uniform, flat dimensions mitigate the need for sorting at the factory and simplify packaging. Similarly, there is no need for installers to sort the sections upon arrival, as would be required with most prior art systems. According to one preferred embodiment, all or most of the sections are predrilled, and each section is already sanded and sealed. Thus, the installers only needs to assemble the floor 30 using pre-configured offset connections. These features all contribute greatly towards simplifying and accelerating installation, ultimately reducing the cost of the floor 30.

Referencing FIG. 2 for illustrative purposes, an installer places a first floor section 42 onto the base 14. The first floor section 42 may be positioned near the center of the installation site. The uniform construction of each floor section 10 allows at least two teams of installers to work simultaneously from either side of the section 42 towards the respective ends of the gym. This simultaneous, multi-pronged installation dramatically reduces the time necessary to install a floor as compared to installment of a conventional floor, which must begin at one corner of a gym floor.

The installers easily position and interlock an adjacent floor section 38 by sliding the appropriate end 48*b* towards the corresponding end 60*a* of an adjacent section 44 of the row 32. The machined offset connection ensures proper staggering between sections. Thus, the installers do not need to measure or otherwise determine where a section should be installed in relation to another in order to achieve a desired Ashlar pattern. They only need to slide the sections together. Furthermore, the machined spacing allows spacers 18*a*, 18*c*, 18*d* to extend outwardly into recesses 50 of an adjacent section 40. The fixed, uniform spacer spacing ensures that the spacers 18*a-d* cooperate with a bottom surface of an adjacent upper layer of the section 40 to secure the sections 10 and 40 together.

Prior to installing next floor section 38 in a row 32, the installer may bolt or otherwise fasten two spacers 18*c* and 52*a* comprising an offset connection at one corner of where the respective sections 10 and 42 abut. A screw 62 may also be used to fasten spacer 60*a* to a center spacer 52*b* of sections 44 and 42, respectively. The installer then slides the floor section 38 into place according to the offset connection of sections 38 and 44. As before, the exposed spacers 18*c* and 60*a* of that connection may be bolted, with the opposite corner of the section 38 being screwed into section 10 via spacers 48*a* and 18*b*.

In this manner, the rows of floor sections 32, 34, 36 are laid out over the base 14 with adjacently located rows being staggered via use of some shortened floor sections at the end wall. Where desired, countersunk screws are used to secure these floor sections near the wall.

Disassembly of sections may proceed in generally the reverse order of the installation. Of note, an edge release feature of an embodiment of the present invention may facilitate disassembly. That is, treatment of the edges of sections prior to installation with a low molecular weight acrylic dispersed in water may mitigate the effects of panelization. Panelization occurs when adjacent edges of sections are effectively sealed together by finisher after installation. This bonding can unduly complicate conventional disassembly. Using the edge release treatment of one preferred embodiment, however, the water-based acrylic, which may include commercially available products such as Mop & Glow®, allows finished panels to separate more easily. This translates into faster disassembly and reduces the potential for damage to the floor. Moreover, the uniformity of the sections minimizes the need for sorting during disassembly, particularly where the surface of the floor is to be refinished.

Compared to prior modular floors, the installation of the present floor 30 is relatively simple and can be done at a lower cost. Due to the structural arrangement of the components, the present invention represents a number of advantages to the end user, primarily due to the achievement of a uniformly stable and strong hardwood floor 30 with substantially lower installation, handling and material costs. For instance, the present invention achieves desired aesthetic and structural support using reduced amounts of maple or other relatively expensive hardwood.

Additionally, the uniform floor sections may be installed without requiring sorting or complicated placement, which minimizes the amount of planning and calculating required by an installation crew. Due to the symmetry and other advantageous configuration of an embodiment of the present invention, it is possible for floor installation to proceed simultaneously in multiple directions. Also, because all of the proper spacing is ensured by virtue of the machined spacers, the installers only need to orient the sections in one direction. All of these labor saving feature translate into installing a floor sixty percent faster than with most conventional modular floors.

While this application describes one presently preferred embodiment of this invention and several variations of that preferred embodiment, those skilled in the art will readily appreciate that the invention is susceptible to a number of additional structural variations from the particular details shown and described herein. For instance, an embodiment of a floor section that is consistent with the principles of the present invention may include spacers that additionally or alternatively extend out from under the transverse ends 24*a* and 24*b* of the wear layer. In another preferred embodiment, the spacers 18*a*, 18*b*, 18*c*, 18*d* may be discontinuous. For instance, discontinuous spacers, or tabs, may extend out from a wear layer 12 with a central portion of the section, coplanar with the discontinuous spacers comprising cardboard or some other spacer layer Such a configuration uses less wood while providing improved acoustics and lighter sections. Sections of still another embodiment that is consistent with the present invention may include spacers oriented at an acute angle with respect to the longitudinal length of the section.

Furthermore, different features of the embodiments of FIGS. 1-4 may be selectively combined to realize other embodiments in accordance with the principles of the present invention. Therefore, it is to be understood that the invention in its broader aspects is not limited to the specific details of the embodiment shown and described. The embodiments specifically shown and described are not meant to limit in any way or to restrict the scope of the appended claims.

We claim:

1. A modular floor covering a substantially horizontal base comprising:

a plurality of like, elongated, rectangularly-shaped floor sections, the floor sections arranged end to end in parallel rows to cover the base, each of the floor sections further comprising:

a wear layer, the wear layer defining a pair of longitudinal sides and having a length and a pair of transverse sides having a width between the longitudinal sides, each of the longitudinal sides having a length and each of the transverse sides having a width, an upper subfloor layer located below the wear layer;

a lower subfloor layer located below the upper subfloor layer, with a recess defined therebetween;

a plurality of spacers residing between the upper and lower subfloor layers and oriented transverse to the longitudinal sides, the spacers extending horizontally outwardly beyond the wear layer on both of the longitudinal sides, a first of the spacers extending along a first of the transverse sides and located inward of the respective first transverse side, and a second of the spacers extending along a second of the transverse sides and located outward of the respective second transverse side, such that the spacers are extendable into the recesses of adjacently located floor sections on both of the longitudinal sides and on one of the transverse sides; and wherein the floor sections interconnect to one another, but are unconnected to the base during use.

2. The modular floor of claim 1 wherein the wear layer comprises elongated floorboards.

3. The modular floor of claim 1 wherein the spacers traverse the entire width between the longitudinal sides.

4. The modular floor of claim 1 wherein the floor sections in a row are arranged in a staggered configuration relative to the floor sections of an adjacently located row.

5. The modular floor of claim 1 wherein each of the sections has longitudinal and transverse dimensions of about 8 feet by 2 feet, respectively.

6. The modular floor of claim 5, wherein each section has ten spacers.

7. The modular floor of claim 5, each floor section further comprising means for removably connecting a first spacer of the respective floor section to a second spacer of an adjacently located floor section.

8. The modular floor of claim 1 wherein the first spacer extends along the entire first transverse side and resides inwardly thereof along the entire width between the longitudinal sides.

9. The modular floor of claim 1 wherein the second spacer extends along the entire second transverse side and resides outwardly thereof along the entire width between the longitudinal sides.

10. The modular floor of claim 1 wherein the lower subfloor layer has a generally planar bottom surface residing in direct surface to surface contact with the base.

11. A method for forming a floor, comprising:

arranging and then interconnecting a plurality of floor sections of the type recited in claim 1, the interconnecting including moving the spacers of a floor section into corresponding recesses of an adjacently located floor section.

* * * * *